United States Patent [19]

McDuffie

[11] 4,406,122

[45] Sep. 27, 1983

[54] HYDRAULIC OIL WELL PUMPING APPARATUS

[76] Inventor: Thomas F. McDuffie, 11926 Taylorcrest, Houston, Tex. 77024

[21] Appl. No.: 203,983

[22] Filed: Nov. 4, 1980

[51] Int. Cl.³ ..... F15B 21/02

[52] U.S. Cl. ..... 60/368; 60/369; 60/372; 60/381; 60/382; 60/476; 92/134; 417/390; 417/399

[58] Field of Search ..... 60/368, 369, 372, 381, 60/382, 476; 91/39, 40; 92/134; 417/390, 399; 74/589

[56] References Cited

U.S. PATENT DOCUMENTS

| | | | |
|---|---|---|---|
| 2,780,063 | 2/1957 | Bacchi | 92/134 X |
| 3,123,007 | 3/1964 | Orr | 91/39 X |
| 3,343,409 | 9/1967 | Gibbs . | |
| 3,971,213 | 7/1976 | Kelley | 60/372 |
| 4,114,375 | 9/1978 | Saruwatari | 60/381 X |

*Primary Examiner*—Robert G. Nilson

*Attorney, Agent, or Firm*—Gunn, Lee & Jackson

[57] ABSTRACT

The preferred embodiment is directed to an oil well pumping apparatus incorporating a walking beam having a horsehead at one end which connects to the sucker rods in the oil well. The opposite end of the walking beam is supported on a fixed pivot. A hydraulic and pneumatic combination unit connects from a supporting platform to a central point on the beam to raise and lower the beam. The improved apparatus utilizes air pressure to balance the static load on the apparatus and dynamically strokes the sucker rod string by imparting a reciprocating motion through hydraulic power applied at a specified rate to raise and lower the walking beam. A pump and motor system for a closed hydraulic loop is included. Alternate preferred embodiments are disclosed. In one form, a lubricating system is incorporated. First and second alternate forms of pickoff apparatus which powers the pneumatically balanced pumping apparatus is also included.

8 Claims, 9 Drawing Figures

HYDRAULIC OIL WELL PUMPING APPARATUS

BACKGROUND OF THE DISCLOSURE

Historically, oil wells which must be produced by artificial lift have used a horsehead-type pumping unit such as those made by Lufkin Industries and others. To counterbalance the weight of the sucker rod string, counterweights are used, either mounted on the walking beam or a rotary-type mounted on the gear box Pittman arm. Another class of pumping unit (also made by Lufkin) uses an air cylinder in place of the metal counterweights. The effect is roughly the same.

The present invention has several advantages, one being omission of a gear box. A combined hydraulic and pneumatic system powers the walking beam and simultaneously counterbalances the weight of the sucker rod string. The pneumatic pressure acts directly on an exposed piston rod or indirectly on a second and larger piston as shown in alternate forms. The hydraulic cylinder is powered by a hydrostatic hydraulic pump which is, in turn, driven by a suitable power source such as an electric motor. To reciprocate the pump up and down in a sine wave motion, a control signal is formed either mechanically or electronically, and the motion of the cylinder is fed back to the input where the signals are compared. In other words, a closed loop feedback system drives the hydraulic cylinder. All forms or shapes of waive motion are feasible, enabling better downhole recovery.

The second and most important aspect of the present invention is the ability to control all factors of the hydraulic cylinder's motion (i.e., speed, dwell time and waveform). Even though a constant prime mover powers the system, one obtains the added ability to control and conform pump motion to the actual production requirements of the oil well. One signal indicating actual well flow is available from several sources such as the production flow from the well being produced across an orifice opening and the pressure drop across the orifice converted into a signal to vary pumping. A more advanced situation involves processing data generated by the pumping unit (position of rods, production pressure, etc.) to control pumping via analysis as taught by Gibbs in U.S. Pat. No. 3,343,409. Gibbs enables analysis of conditions at the bottom of the well and a manner of using this analysis of data to signal the pumping unit servodrive to change the driving signal to achieve maximum production. Gibbs has a rather good textbook discussion of the advantage of obtaining well production just at the pumped off point, and with this invention, it is possible to do that on a continuous basis without attention by the lease operator.

An important aspect of this invention is the linking of the operation of the pumping unit to the actual production of the well. While this is best accomplished by the hydrostatic hydraulic unit proposed, it is not limited to this type prime mover. By using this or other variable speed devices, a retrofit to existing oil wells or artificial lift can be obtained.

Gibbs discusses the relationship between a tophole dynamic measurement and actual downhole pump requirements. The reference discloses that a long string of sucker rods distorts the force required and dynamic loading actually experienced at the pump. Through the teachings of Gibbs, it is possible to measure surface dynamic data and obtain better performance downhole. This apparatus enables the power plant to drive the walking beam in a controlled manner so that the movement of the walking beam is controlled in frequency, dwell time, wave shape and excursion.

The present invention is an improvement over the Lufkin equipment. The present invention is a structure which utilizes not merely a passive air tank for counterbalancing, but a dynamic combined hydraulic and pneumatic system. From the exterior, it can be seen to include a large air tank with protruding piston rod which functions to counterbalance the load of sucker rods hanging on the walking beam. The equipment, however, goes much further. Through the use of a hydrostatic hydraulic pump and a closed hydraulic circuit, it incorporates a double-rod, double-acting piston which is positively driven in both directions, the piston enclosed in a cylinder and there being a protruding piston rod whereby the hydraulic equipment strokes the walking beam to obtain the necessary pumping action. This more readily accommodates variations in operation. Variations include waveform, frequency, dwell time and excursion. Frequency, length of stroke, dwell time and waveform are important factors in controlling the pumping operation. This is an optimum range of conditions for a given producing well. It cannot be pumped off too rapidly, and yet, maximum production is obtained by pumping at an optimum high frequency waveform. If the well is pumped off, damage may occur in that the sucker rods may be bent by slapping the pumping element against the accumulated oil in the well if it is below level. Further, the length of stroke of the equipment is also very important in obtaining optimum production from the well. In general, long strokes and slow speed are best, the present invention lending itself to long stroke-slow speed operation.

The present invention is thus a pumping unit which can be adjusted quickly and easily to accommodate great variety in pumping motion. It also accommodates variations in counterbalance load. These variations are implemented by simply adjusting pressure regulators or valves, or sensing dynamic operation.

Alternate forms of the present apparatus are disclosed. One variation is the incorporation of an alternate form of a lubricating system in conjunction with the double piston arrangement. Another alternate form discloses two modes of connecting the pickoff apparatus which determines the position of the walking beam. This, in turn, is connected to the pump which controls delivery of the hydraulic oil under pressure for operation of the walking beam.

The control system can be modified to sense downhole load to thereby further modify the cycle of operation of the equipment.

BRIEF DESCRIPTION OF THE DISCLOSURE

The present invention incorporates a platform with an upstanding post which serves as a pivot for a walking beam. The walking beam includes a horsehead with a standard connection for sucker rods via a horsehead on the end of the walking beam. It pivots at one end, and the present invention incorporates a piston and air cylinder which pivotally connects from the supporting framework to a midpoint on the walking beam. The cylinder encloses an air operated counterbalance mechanism which imparts a force against the walking beam to counterbalance the dead weight on it. In addition, the cylinder encloses a hydraulically powered, double-rod, double-acting piston and cylinder arrangement which is driven to reciprocate the walking beam mechanism. Hydraulic power is obtained from a motor and pump, the pump having a position responsive controller delivering hydraulic oil to the hydraulic cylinder in such a manner that all aspects of speed, acceleration, waveform and dwell are controlled.

One form of the present invention utilizes a platform with an upstanding post which supports a walking beam at a pivot. The walking beam includes a horsehead with a standard connection for sucker rods which are appended from the end of the walking beam. The platform supports an upstanding cylinder, the cylinder enclosing a common piston rod with a serially connected air piston and separate hydraulic piston. The hydraulic piston is enclosed in a double-acting chamber to provide motive force. The air piston is enclosed in a chamber and is made single-acting to emulate an air operated counterbalance mechanism working against the walking beam to offset the dead weight suspended from it in the sucker rods. The device is driven hydraulically to reciprocate the walking beam mechanism. There is a reservoir of lubricating oil to maintain a good seal at the air cylinder.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE ILLUSTRATED EMBODIMENT

Figure 1:
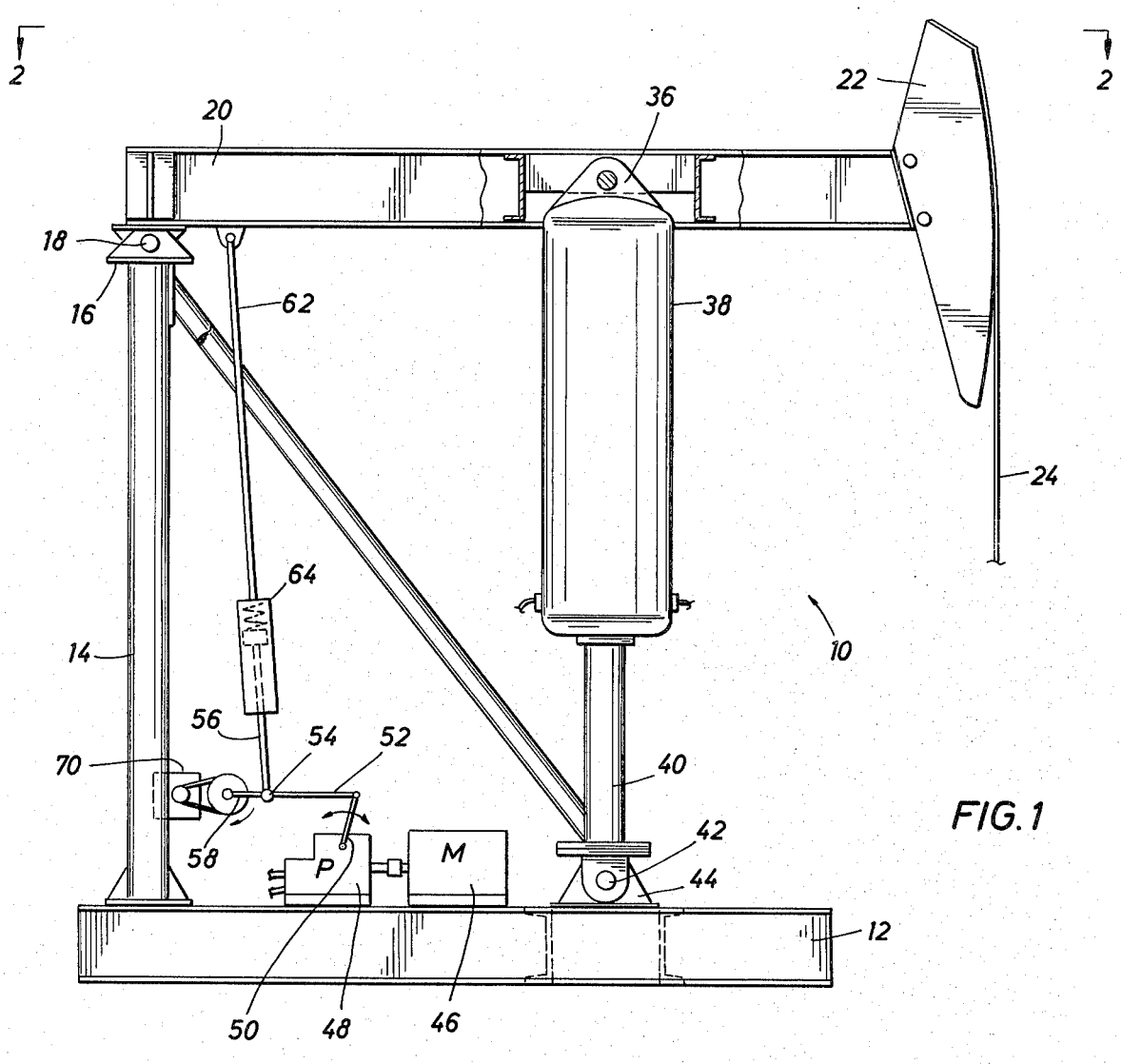
FIG. 1 is a side view of the walking beam power apparatus of the present invention showing disposition of the major parts thereof.

In FIG. 1 of the drawings, a walking beam pump apparatus in accordance with the teachings of the present invention is illustrated. The apparatus incorporates a base or lower platform 12 which is formed of a set of parallel frame members and suitable transverse frame members to complete the base structure 12. It further includes a pair of upstanding posts 14 which support a top located clevis 16 which, in turn, supports a pivot pin 18. The pin 18 supports a horizontal frame member 20. It will be observed that the post 14 is duplicated at two locations on the equipment; it is believed unnecessary to describe the duplicate equipment because it functions in the same manner as the equipment described to this juncture.

The frame member 20 is a horizontal beam extending forwardly of the equipment. The beam 20 pivots around the pivot 18. It is able to rotate in an oscillatory motion about that axis. The outer end of the beam 20 is joined to a horsehead 22 which rotates through an angular extent determined by the beam and its pivot. The horsehead 22 supports a polished rod 24 which, in turn, extends into a well to be pumped and is connected with a string of sucker rods extending down the well to the pump. The sucker rods and associated equipment place substantial weight on the walking beam. This weight has been counteracted heretofore through the use of counterbalances and the like.

Figure 2:
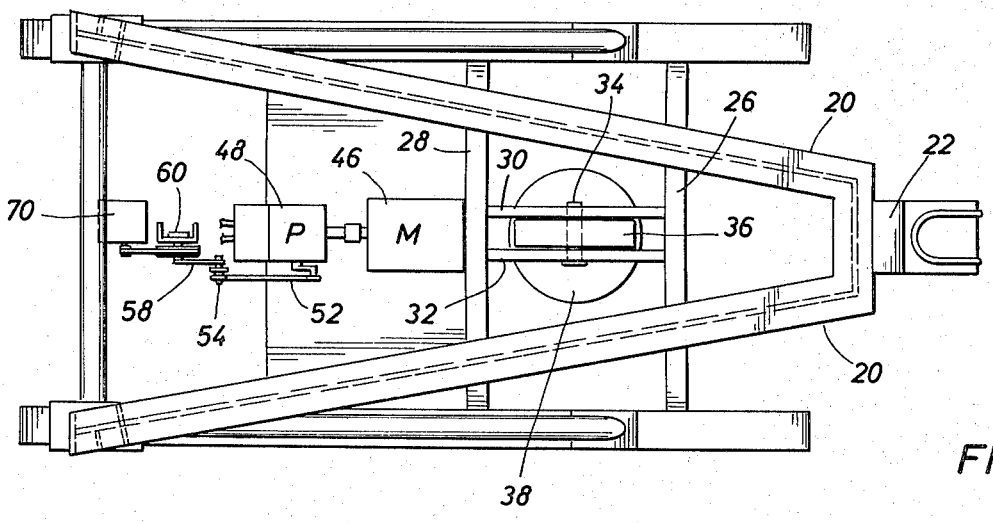
FIG. 2 is a plan view of the apparatus shown in FIG. 1 showing additional details of construction.

In FIG. 2 of the drawings, the beam 20 supports transverse frame members 26 and 28. They, in turn, support frame members 30 and 32, and a pin 34 is held in a generally horizontal posture between them. The pin is fastened to a tab or eyelet 36 affixed to a cylindrical tank 38. The tank 38 is a closed cylindrical housing having a closed upper end and lower end. The cylinder 38 encases one end of the equipment, and a piston rod 40 extends from it. The rod 40 is joined to a pivot 42 which, in turn, passes through a suitable clevis mount 44 carried at the base of the frame 12. The piston rod 40 and the tank 38 define a hydraulic and pneumatic counterbalance and drive system. This will be described in greater detail in reference to FIG. 3 of the drawings.

The numeral 46 identifies a prime mover, such as an electric or gasoline motor. It has an output drive shaft and is connected to a hydraulic pump 48. The pump 48 delivers hydraulic oil under pressure. The pump 48 has a dual line output. It has a control lever 50 which can be wobbled forwardly and rearwardly. There is a neutral, nonpumping position, and forward movement results in pumping in one direction, while reverse movement of the lever results in pumping in the other direction. The pump, therefore, is bidirectional in operation. Of the two outlet lines, one, of course, serves as a return when it is not being used as the delivery line. The pump 48 thus has three operative states, pumping through one outlet, pumping through the other outlet and a neutral, nonpumping position. It is subject to control of the lever 50. The lever 50 is driven by a push rod 52 which connects with a pivot 54. The pivot 54 supports a vertical push rod 56. A bell crank 58 is also connected to the pivot 54. The bell crank 58 rotates in a full circle about a pivot 60 and is driven by a small motor 70 and suitable belt drive.

The pump 48 is the prime mover for operation of the oil well pumping unit 10. It runs under control of the lever 50. The pump is thus operated in the following manner. The bell crank 58 is rotated in a circular fashion. The pivot 54 and the control arm 52 transfer the circular motion and convert it into oscillating motion for the control lever 50.

Advance and retardation of the pumping action described above is achieved by means of a connective link 62 extending from the beam 20 to a shock absorber 64.

The shock absorber 64 has a central position, and excessive axial loading on the rod 62 is accommodated in the shock absorber. The shock absorber serves to advance or retard the bell crank 58. As it retards or advances the bell crank in its movement, it forces the lever 50 to a different position. It is a feedback mechanism whereby the walking beam movement is fed back to control the pump 48.

In operation, the bell crank 58 rotates. It is either slowed or accelerated by the push rod 62 and the shock absorber in it. This couples and conveys necessary movement for operation of the pump 48 to the pump controller lever 50.

The bell crank 58 is rotated by a belt drive from a small motor 70 in FIG. 2 of the drawings. It is preferably sufficiently small that it is not able to overpower the feedback rod 62. This permits it to stall or at least to slow down during its operation.

The motor 70 acts as the input signal device and functions as a sine wave generator. The sine wave determines pumping waveform and speed to the extent permitted by feedback from the rods 56 and 62. The motor 70 maintains full control until feedback from the rods 56 and 62 modify rotation.

The present apparatus operates, at least to this juncture, in the following manner. The bell crank 58 is rotated, and, as it rotates, it elongates the rod 62 which elongation is accommodated in the shock absorber 64. The shock absorber 64 preferably has the form of a piston in a cylinder. The piston is centralized by hydraulic pressure in the cylinder. A return spring assists in centering the shock absorber. Eventually, of course, motion is coupled to the control lever 50, and the pump is thereby actuated.

Figure 3:
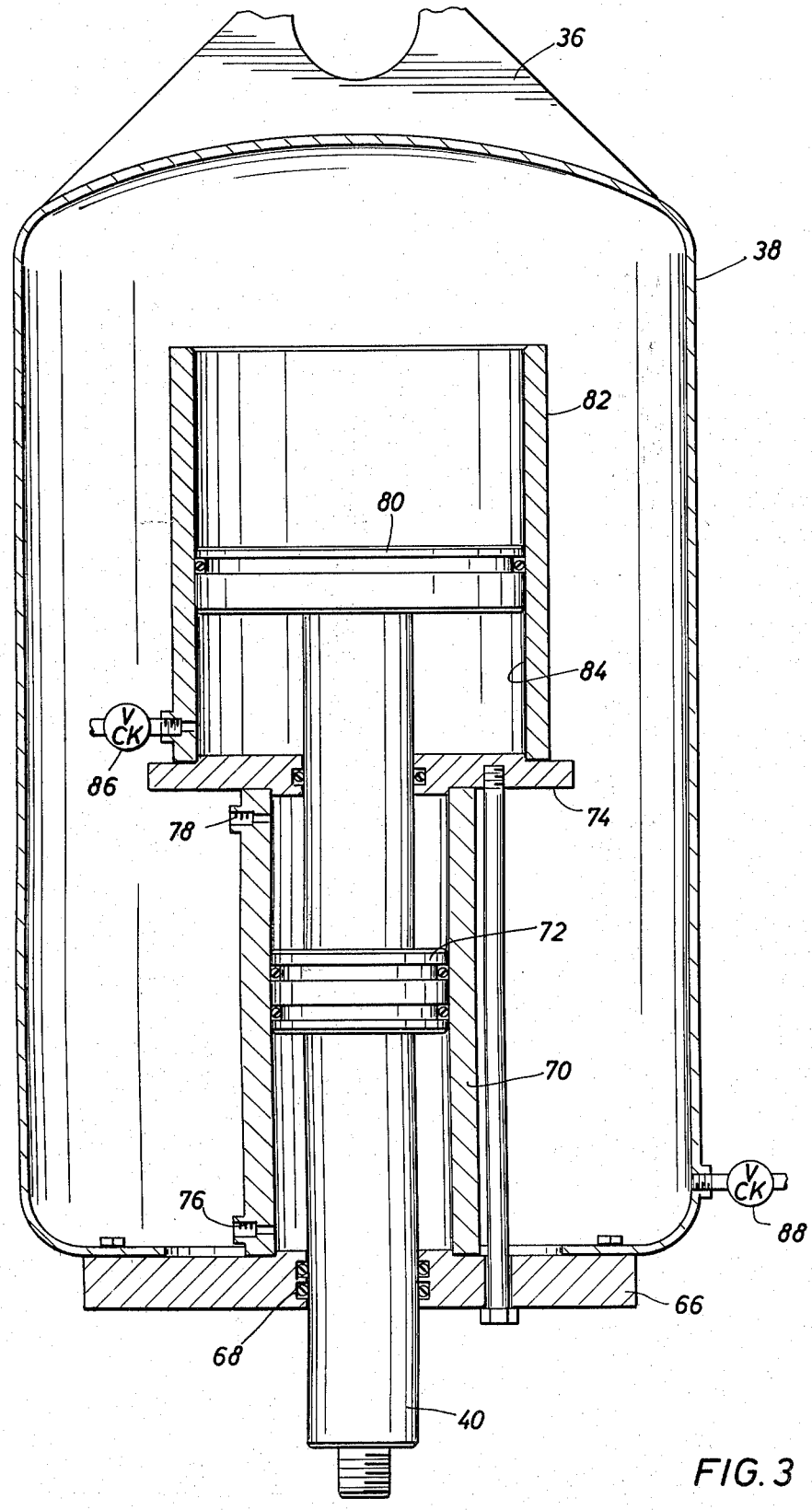
FIG. 3 is a sectional view through the air operated counterbalance mechanism including hydraulically driven equipment in the present apparatus.

The present apparatus includes the cylinder 38 and piston rod 40 shown in FIG. 3. The cylinder tank serves as a connector, and, to this end, it includes the centrally located clevis 36 at the upper end. The tank 38 incorporates a bottom or base plate 66 for reinforcement. The piston rod 40 passes through it, and leakage along the piston rod is prevented by seals 68. The base plate 66 supports the tank body proper and an upstanding, cylindrical sleeve 70. The sleeve 70 encompasses the piston rod and, on the interior, receives a hydraulic piston 72. A hydraulic chamber is defined above it and also below it. The lower chamber is defined by the base plate 66 which supports the cylindrical sleeve 70. The upper cylindrical chamber is defined by the head plate 74 which is transverse to the cylindrical sleeve 70 and is sealed at the upper end. The piston rod 40 passes fully through the equipment. That is to say, the piston rod passes through both hydraulic chambers. The lower chamber includes a fitting 76, and the upper chamber has a fitting 78, the two fittings being adapted to be connected with the pump. When hydraulic fluid is introduced through the fitting 76 by a conduit (not shown) from the pump 48, it forces the piston upwardly and shortens the length of the tank 38 and the piston rod 40. Conversely, when hydraulic fluid is forced through the fitting 78 into the upper chamber, it forces the piston downwardly and lengthens the piston rod and cylinder, thereby resulting in a stroke of the equipment in the opposite direction.

The tank 38 is filled with air at a specified pressure. The air in the tank works against a piston 80 received in a sleeve 82. The sleeve 82 is supported on the head 74. The piston 80 is affixed to the piston rod 40. It, thus, has an upper face which works against pressure, the pressure level being determined by the pressure within the tank. It has a lower face exposed to a lower chamber 84 which is a closed and sealed chamber. A suitable check valve 86 is provided so that any air trapped in the chamber 84 can be expelled. After a few strokes, a vacuum is formed and maintained. This is desirable so that maximum differential air pressure will be realized.

A check valve 88 is used in conjunction with an air supply and pressure gauge to fill the tank 38 to a specified level. Air is introduced into the tank 38 at a specified level, perhaps 300 psi. As this occurs, the piston 80 is forced downwardly. It travels downwardly, but, as it moves, the air in the chamber 84 is compressed and is forced out via the check valve 86. Power to do this is supplied by the hydraulic cylinder. As the piston 80 moves back up, a vacuum or low pressure area is formed in the chamber 84 and maintained by the check valve 86. Movement of the piston, however, extends the piston rod 40. As the piston rod 40 is extended, a counterbalancing force is applied to the bottom side of the walking beam shown in FIG. 1. It will be appreciated that this force is applied against the beam to restore a balance of force offsetting the effect of the weight of sucker rods appended to the pumping apparatus. The air pressure in the tank thus serves as a counterbalancing weight. An increase of pressure in the tank 38 simulates an increased counterbalance weight.

The pneumatic portion of the equipment shown in FIG. 3 accomplishes a counterbalancing force to substitute for counterbalance weights. The counterbalance weights are omitted, and the pneumatic restoring force is substituted in lieu of counterbalance weights. The present invention also incorporates the double-acting hydraulic piston 72 for pumping action. A relatively small force, however, is required to pump because the system has been counterbalanced so that the offset weight of the sucker rod string is reduced to a minimum.

The hydraulic equipment strokes the pump and works against a minimum force inasmuch as the counterbalance force pneumatically obtained offsets the weight of the sucker rod string and reciprocating equipment. Therefore, the hydraulic motor and associated equipment drives the pump at a specified speed determined by the motor 70. The motor 70 is preferably a fractional horsepower, variable speed, hydraulic motor which can be driven at some range of speeds, typically from about 0.5 rpm to about 20.0 rpm (ignoring the ratio of the belt drive and pulleys). A speed of 0.5 rpm to about 20.0 rpm at the bell crank 58 (modified by the lag rod 62) drives the pumping equipment at a speed which can be tailored to the well conditions for proper production of oil.

An important feature incorporated in the system is the ability to overcome unduly resistant loads. If the walking beam stalls, which would occur in the event the hydraulic motor could not overcome the resistance to movement, the stall is coupled through the lag rod 62 to the lever 50 and, thereby, opens the lever 50 to a greater extent. If this were to occur, more hydraulic fluid is delivered, and the resistant force can then be overcome. The reverse situation is also possible.

The present invention is a unit which can be scaled to wells which have small weight loads and those which have very large weight loads. The pump can be operated very rapidly or very slowly. While the length of stroke can be shortened, it is not normally done since maximum stroke length is most often preferred.

Figure 4:
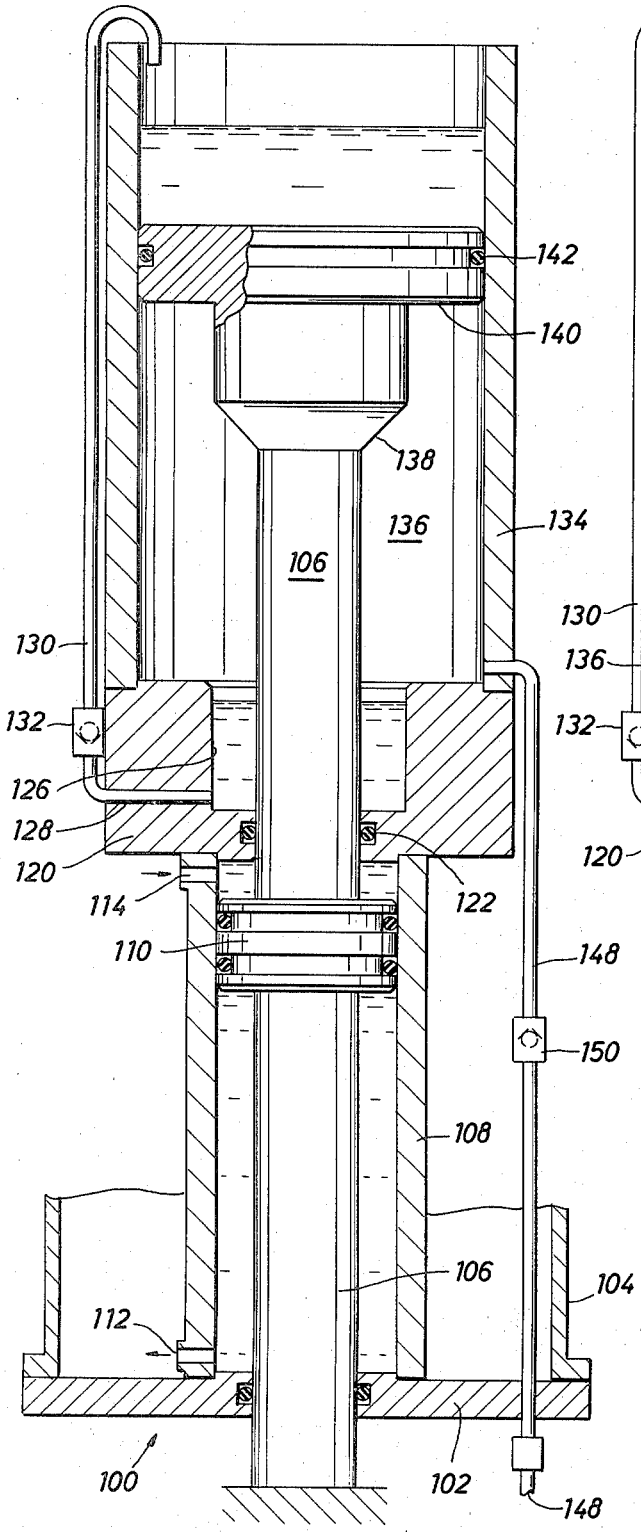
FIG. 4 is a sectional view through an alternate form of the air operated counterbalance mechanism incorporating an oil lubrication system.
Figure 5:
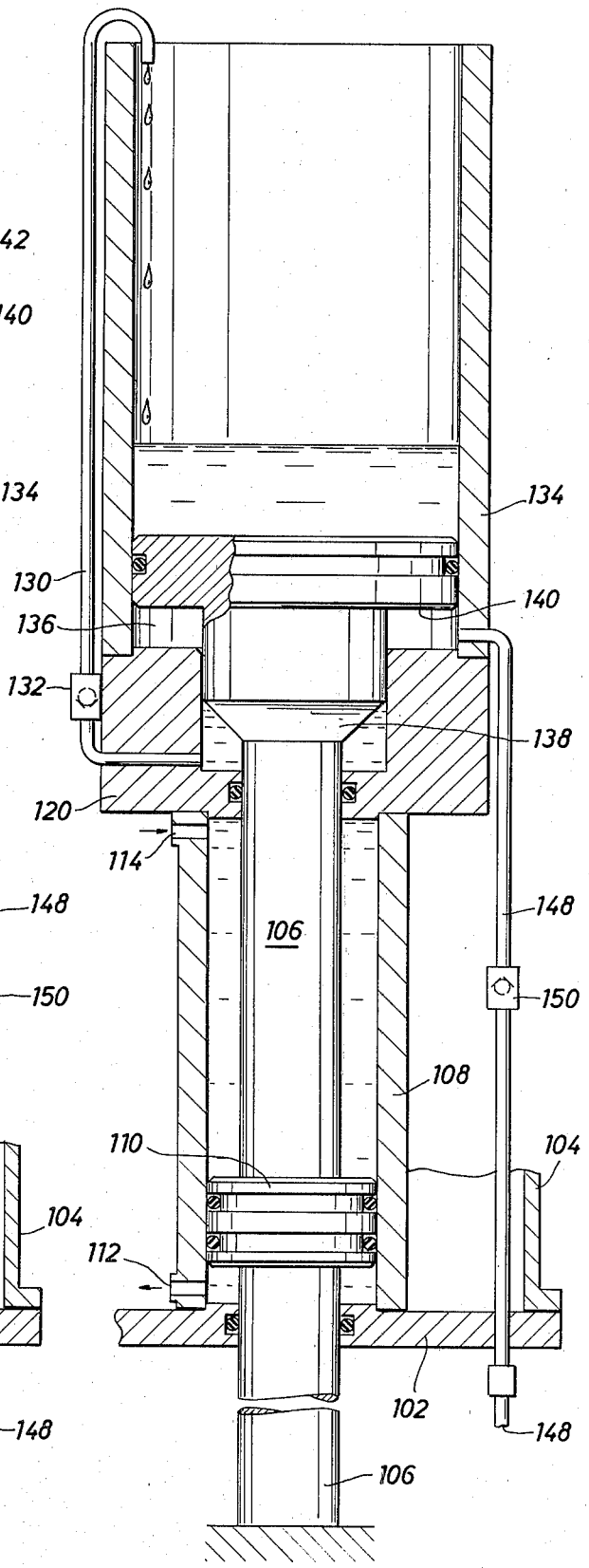
FIG. 5 is a view similar to FIG. 4 showing operation of the equipment on the downstroke of the common piston rod and connected cylinders.

Attention is directed to FIGS. 4 and 5 considered jointly. The same apparatus is shown in both views. The views differ in that the device has partially moved, thereby altering the relative position of the components. The numeral 100 thus identifies the air counterbalanced hydraulic power plant. The bottom plate 102 corresponds to the plate 66 shown in FIG. 3. An upstanding cylindrical housing 104 fully encloses all of the apparatus shown in FIG. 4, extends above it and terminates at a connection at the top end in the manner shown in FIG. 3. A piston rod 106 extends downwardly from the equipment. The piston rod 106 extends relatively downward, thereby raising the cylindrical tank 104. This forces the walking beam upwardly. The piston rod extends into the closed cylindrical tank 104 to convey movement to the walking beam. The lower end of the piston rod 106 is anchored to the platform therebelow in the manner depicted in FIG. 1. The upper end of the cylindrical tank 104 is pivotally connected to the walking beam so that the apparatus shown in FIG. 4 can be substituted for the apparatus found in FIG. 1.

A seal is perfected at the piston rod 106 where it emerges from the bottom plate 102. The bottom plate 102 supports a second upstanding cylinder 108. The cylinder 108 is a hydraulic cylinder. A piston 110 supported on the piston rod 106 moves in reciprocating fashion within the cylinder 108. It defines hydraulic oil receiving chambers above and below the piston 110. The lower chamber is defined by the bottom plate 102. An inlet is incorporated at 112, and this is connected with a hydraulic pump. The upper chamber has a hydraulic inlet fitting at 114. The upper chamber is above the piston 110. A cylinder head 120 terminates the upper chamber. The piston rod 106 extends fully through both chambers.

The cylinder head 120 is a multi-function component. It serves as a guide for the piston rod, aligning the piston rod at a seal 122. The piston rod 106 passes through the cylinder head 120 and extends above it. The top side of the cylinder head 120 incorporates a reservoir 126 which is concentric about the piston rod 106 and which collects lubricating oil in it.

The oil sump 126 collects oil which flows down the piston rod 106. Oil is evacuated from the sump through a line 128 which is continued by the upstanding column 130 which extends over the top end of the equipment. A check valve 132 limits backward flow in the line 128. As oil is forced under pressure through the check valve 132, it is delivered over the top of the upstanding cylindrical wall 134. The wall 134 encircles and defines a chamber 136 which is above the cylinder head 120. The chamber is further closed by the piston 140. The piston rod 106 passes fully through the chamber 136 and incorporates an enlargement 138 on the lower side. The enlargement 138 is sized to stab into the reservoir 126, thereby pressurizing oil in the reservoir. As oil is compressed in the reservoir 126, it is forced out of the reservoir through the line 128. The oil flows to the top side of the piston 140 and accumulates on the top side. A certain quantity of the oil will accumulate and flow down the interior wall, lubricating the seal 142. Ideally, very little leakage occurs, and the seal 142 maintains an airtight seal.

The chamber 136 operates in the same manner as the chamber 84 of FIG. 3. As the piston works up and down, trapped air is expelled, and a pressure approaching a vacuum is formed. This maximuzes the differential pressure between the chamber 104 and the chamber 136. If, for instance, the chamber 136 is reduced in size to a very small size on the downstroke, air in it will be forced through the check valve 150. Flow in the reverse direction is prevented. This relieves the chamber 136 so that its pressure does not exceed a specified level, and, in fact, will approach a vacuum on the upstroke.

The contrast in FIGS. 4 and 5 shows the rod 106 moving relatively downwardly to raise the walking beam. One important feature observed in FIGS. 4 and 5 is the hydraulic system which pumps oil from the reservoir 126. The oil is delivered to the top of the piston 140. The level of oil has been exaggerated for purposes of clarification. The precise amount is variable; the benefit of the oil is lubrication and prevention of leakage. The oil basically coacts with the seal ring 142 to limit blowby at the piston 140.

The embodiment shown in FIGS. 4 and 5 differs from the embodiment previously depicted at FIG. 3 in the incorporation of the pneumatic lubrication system. It has the distinct advantage of extended life as a result of the lubrication system.

Figure 6:
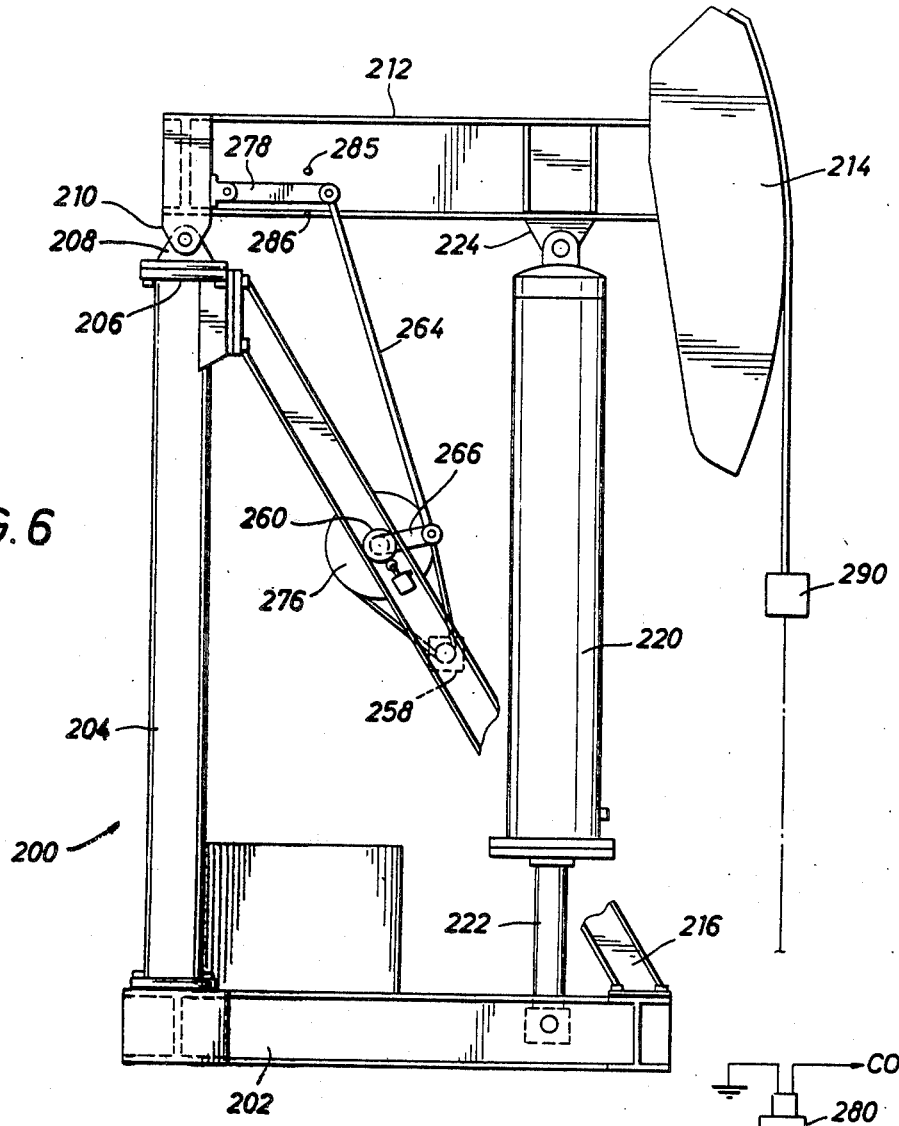
FIG. 6 discloses an alternate form of motion detection apparatus.

Attention is next directed to FIG. 6 of the drawings where a modified form of the apparatus for detecting the instantaneous position of the walking beam is shown. FIG. 6 is similar to FIG. 1 in major components and differs primarily in the apparatus detecting the position of the walking beam. FIG. 6 thus discloses in the pumping apparatus 200 a lower platform 202. The platform has a pair of upstanding posts 204 which support a transverse beam 206. The beam 206 has an upstanding clevis 208 which is pivotally connected to a downwardly projecting tab 210 on the walking beam 212. The walking beam 212 extends to a horsehead 214. The upstanding equipment is braced by an angularly positioned brace 216. Ideally, separate spaced braces 216 are used. As shown by the sideview of FIG. 6, the triangular arrangement of the framework including the platform 202 rigidly fixes an anchor for the walking beam 212 which pivots about a fixed axis.

The hydraulically powered cylinder 220 is additionally shown in FIG. 6 incorporating a piston rod 222 extending from it. It is air counterbalanced as taught by the present disclosure. The cylinder is pin connected at 224 to the bottom side of the walking beam 212. The walking beam also connects to a string of sucker rods in the conventional manner.

Figure 7:
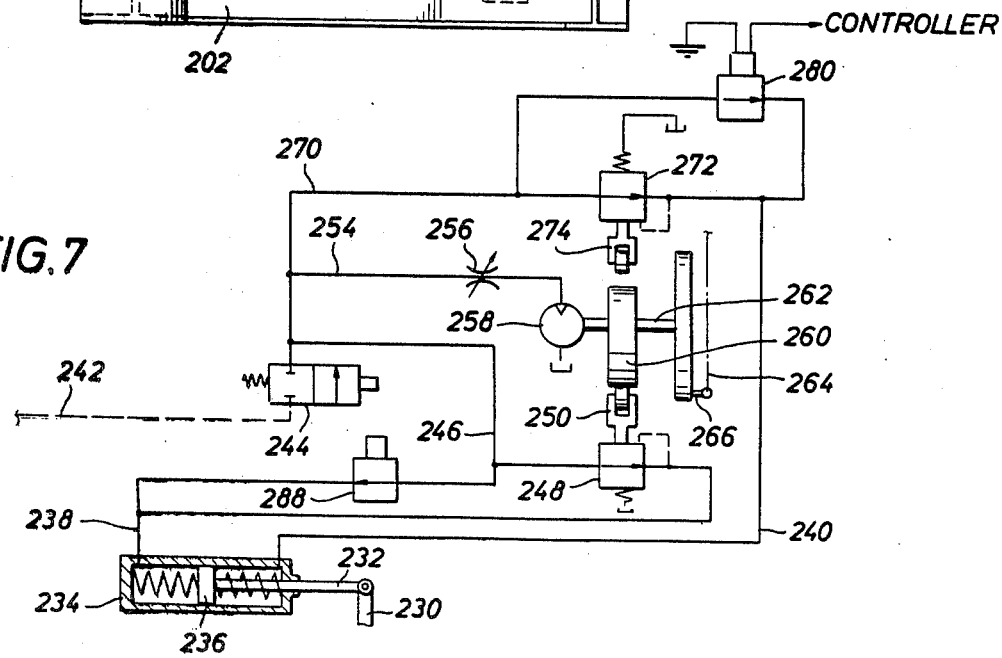
FIG. 7 is a schematic of the hydraulic system in FIG. 6 showing details of interconnection for control of the apparatus.

In FIG. 7 of the drawings, the control system for powering the hydraulic pump is illustrated. The numeral 230 identifies a control arm for a pump control head. It has a central neutral position. When it moves to one side, it pumps in one direction, and movement on the other side of neutral operates the pump to deliver oil in the opposite direction. The power unit for the equipment thus comprises a prime mover, a pump and a pump control system which causes the pump to deliver oil under pressure at one of two outlet lines, the other line serving as a return line.

The control arm 230 is connected to a control rod 232 from a spring-centered hydraulic cylinder 234. The cylinder 234 incorporates a centered piston 236 and equal opposing springs to locate the piston 236 at a central position. One hydraulic control line is identified at 238, and the other is 240. With no pressure applied, the piston centers itself, and this corresponds to neutral for the pump.

The numeral 242 identifies a hydraulic line from the main pump. It is a supply line delivering an adequate flow of oil for operation of the control apparatus. The line 242 is input to a normally closed valve 244. It is spring returned to the closed position. The valve 244 serves as a kill switch and pause control for the apparatus. Ideally, it is hand actuated to the on position. When on, flow is then permitted for powering the control equipment. Operation of the valve 244 to the on condition delivers oil under pressure to the conduit 246 and to other lines to be described. This passes through a cam operated pressure reduction valve 248. The valve 248 is spring returned to the vent position. It cooperates with a cam follower 250 which gradually closes the valve 248. As the valve 248 is closed, increased pressure is sent through the conduit 238, compressing the spring in the cylinder 236 to move the lever 230 to stroke the pump.

The kill switch 244 provides hydraulic oil through the conduit 254. The conduit 254 is choked through a variable choke 256 and input to a small hydraulic motor 258. The motor 258 includes a return to sump. The motor 258 rotates a cam 260 which is mounted on a shaft 262 for rotation. The cam 260 is also rotated by movement coupled from a Pittman arm schematically represented in FIG. 7 at 264. The arm 264 is connected to the walking beam by the Pittman arm 278. The Pittman arm 278 is allowed some range of movement by the adjacent pins 285 and 286. These pins define a selected dead band enabling the servosystem to track within limits. The Pittman arm connection is input to a pivot point 266. The cam 260 is positioned by two different forces applied to it. One is rotation of the motor 258. The other is the feedback which is accomplished through the Pittman arm connection 264.

FIG. 7 further discloses an inlet line 270 which connects through a cam operated pressure reduction valve 272. This valve has a spring return to the vent condition. Additionally, it has a cam follower 274 which follows the cam 260. It will be observed that there is a phase angle between the valves 248 and 272. They respond to the cam as it rotates, but there is a phase lag in the response of one compared to the other. This is desirable inasmuch as the two control valves apply hydraulic oil to the spring centered cylinder 234. This, in turn, powers operation of the equipment when an imbalance exists at the cylinder 234.

Going back to FIG. 6 of the drawings, the motor 258 is mounted on a fixed member to belt drive a pivotally mounted rotatable disk 276 which, in turn, rotates jointly with the cam 260. The cam 260 incorporates the Pittman arm connection 266 which joins to the Pittman arm 264. The Pittman arm 264 is connected to a pivotal tab 278 which rocks to and fro with the walking beam 212 and communicates walking beam movement to the Pittman arm 264. Oscillatory movement of the arm 264 is limited by the pins 285 and 286 to define limits relating to the servoloop. In the event (considering a worst case) that the walking beam 212 is stalled, the Pittman arm 264 does not move. The motor 258 attempts to rotate, thereby rotating the cam 260. This, however, is opposed by the stalled Pittman arm coupling, and no rotation occurs. When stalling occurs, it holds open one or the other of the cam operated valves 248 and 272. This continues to apply power and thereby opens the pump further. As more hydraulic oil is delivered, the hydraulic apparatus overpowers the stalled condition and moves the walking beam.

Actual movement of the walking beam includes length of stroke and pumping rate. Changes in all variables are multifunction variables in large part dependent on the pumping apparatus and certain downhole conditions. The apparatus described hereinabove is responsive to these conditions. It functions without predictive input. Predictive input enhancement through the use of a technique of measuring the sucker rod and downstream pump performance is taught in the patent of Gibbs bearing U.S. Pat. No. 3,343,409. It is possible to develop downhole dynamometer graphs for bottomhole operation. Typically, the graph is a chart of load and displacement as a function of time. As shown in FIG. 6 of the referenced patent, the dynamic load on the pump downhole may well vary as a function of time. The load which is sensed at the surface (and particularly at the polished rod) is distorted from the form of FIG. 6 of the referenced patent inasmuch as the pump loading must be coupled upward through several thousand feet of sucker rods. There is the inevitable time lag and some stretching which occurs in the sucker rod string. Moreover, the pump experiences loading as a result of pumping operations; the polished rod experiences loading as a result of pump operation plus column deflection of sucker rods. The string of sucker rods inevitably is loaded to a greater extent above the pump, and the maximum loading occurs at the polished rod at the wellhead. The Gibbs reference has the advantage that only one type of measurement is obtained in dynamic operation. It requires as a preliminary matter certain specifics about the sucker rod string, but these are dimensional values which do not vary for installed equipment. It requires, for instance, measurement of the area of each rod size in the string, the combined length of the rods in the string, the weight of the sucker rods and the pump connected to it, and the weight of the portion of the sucker rod string which is suspended in well fluid. The Gibbs patent utilizes the technique of measuring a displacement wave which travels along the sucker rod string. Utilizing the Gibbs approach, it is, therefore, possible to operate the apparatus shown in FIG. 7 to the following end.

The illustrated control system of FIG. 7 incorporates a control valve 280 parallel with the valve 272. It is a solenoid operated control valve receiving a suitable operating signal from a controller which forms an electrical drive signal for the solenoid control valve 280. It has the ability to override the valve 272 because it has larger capacity. Thus, the control system of FIG. 7 functions in the manner described hereinbefore, thereby controlling pumping through the valves 248 and 272. It is responsive only to the load actually experienced on the hydraulic pump which powers the equipment. To add predictive control for the express purpose of obtaining a more desirable dynamometer card at the downhole pump, the valve 280 is operated with signals from the controller to overcome or override the valve 272. The valve 288 is a similar arrangement incorporated to override the valve 248. It, too, is connected to the controller. The controller makes calculations based on strain gauge measurements through the installation of a strain gauge at 290 in FIG. 6, all as taught by Gibbs. Since hydraulic pressure and air pressure is a measure of sucker rod load and since a device on the walking beam shows displacement or travel of the sucker rods, a strain gauge is not always necessary but could be used if desired.

In summary, control valves 248 and 272 respond to actual hydraulic power demands. The predictive system including two valves 280 and 288 overrides (continued operation valves 248 and 272 being overcome) and modifies control pressures to the control cylinder 234. Overriding is quite easy; it is primarily a matter of the extent of valve opening.

While the foregoing describes the cycle of operation of the control system shown in FIG. 7, several operating variations should be considered. Where the system operates in a very smooth and routine fashion, the motor 258 drives the system by rotating the cam 260, and the valves 248 and 272 are operated in the ordinary course. A time lag between application of power and pumping stroke is accommodated through the Pittman arm connection, and this is coupled to the equipment from the Pittman arm 264 and through the connective link 266. This will to some extent override the motor 258. Further overriding is achieved by the valves 280 and 288. They are forward looking or predictive control valves and operate on signals from the controller. The controller is a predictive control system utilizing strain gauge measurements from the strain gauge 290 shown in FIG. 6.

Figure 8:
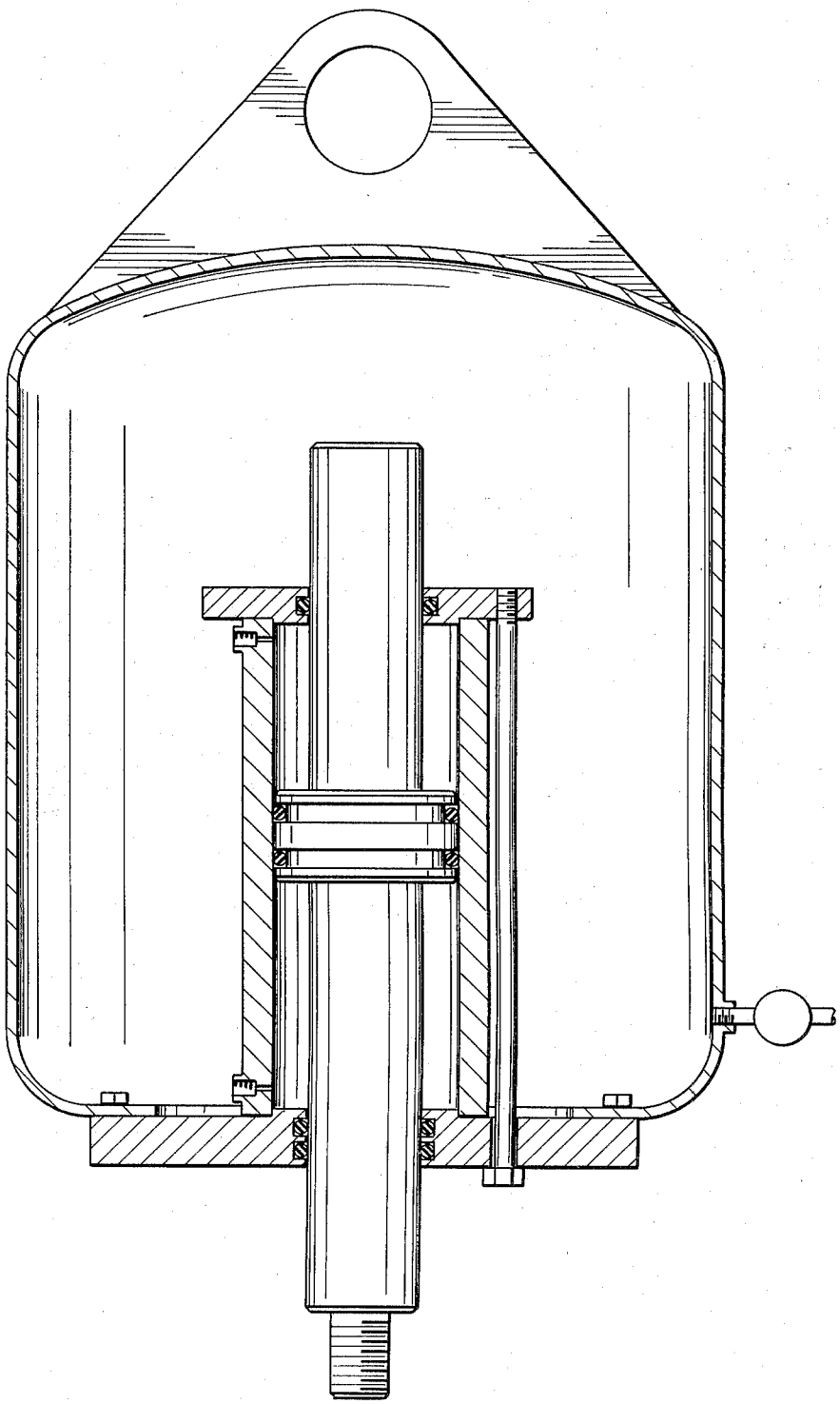
FIG. 8 is a drawing of an alternate cylinder arrangement showing air pressure working directly on the upper piston rod.

FIG. 8 discloses an abbreviated form of counterbalance pneumatic piston. The arrangement includes a complete hydraulic piston which is double-acting in the same manner as depicted in FIG. 3. The top or pneumatic piston is omitted, and air pressure acts against the exposed piston rod. The cumulative force is a function of air pressure differential acting on the exposed face of the piston rod.

Figure 9:
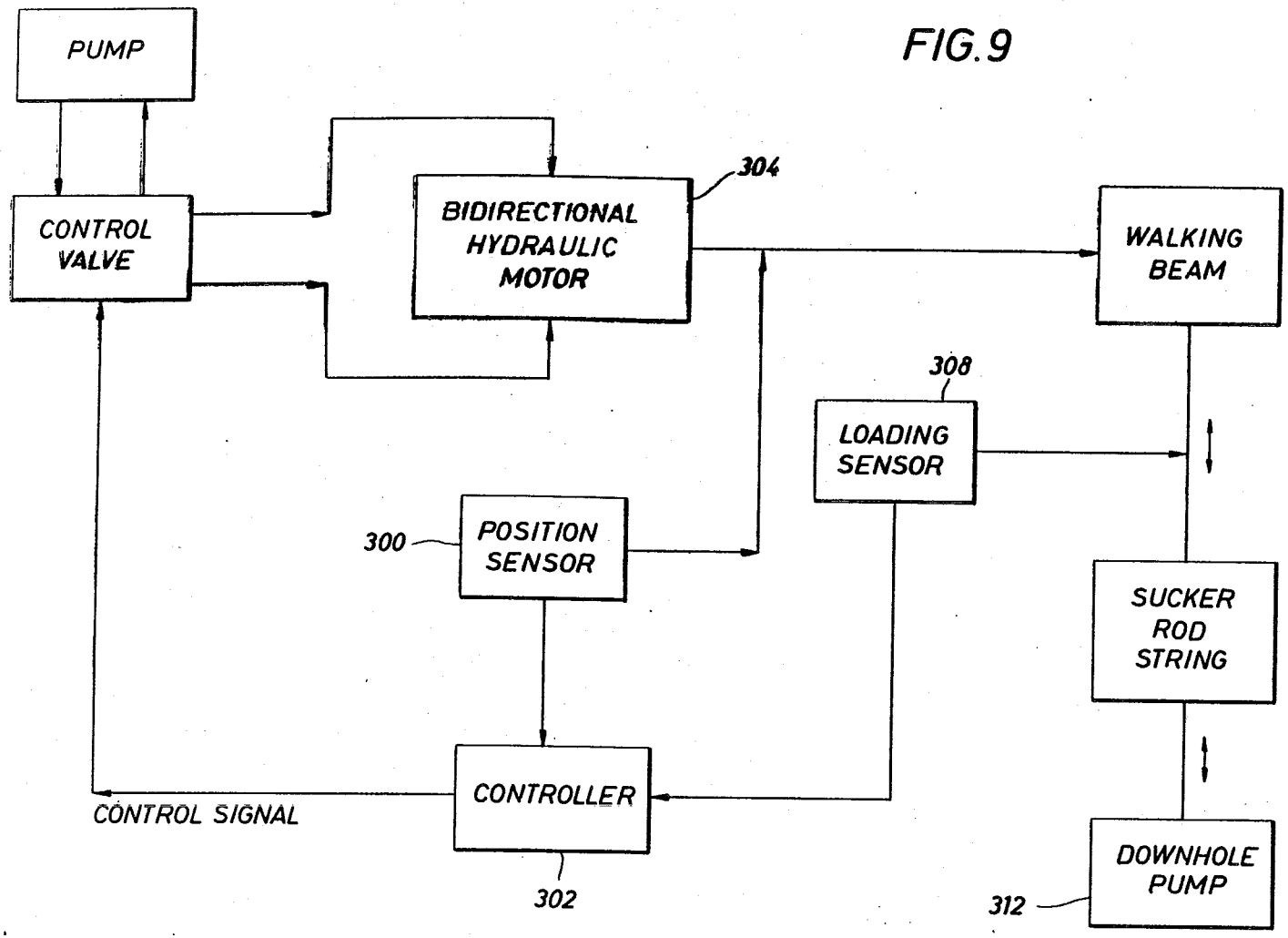
FIG. 9 is a schematic of the control system involved in the present apparatus.

FIG. 9 shows the control arrangement found in FIGS. 1, 6 and 7 in general form. Briefly, a servoloop is included, at least responsive to walking beam movement. Speaking very generally, the position sensor 300 follows walking beam movement and forms a control signal through operation of the controller 302. The controller 302 is able to open or close the valve to vary hydraulic flow to the hydraulic motor 304. The motor 304 drives the walking beam.

An added variation is a load sensor 308 responsive to sucker rod loading at the well head. This signal can be used as taught by Gibbs to convert into a downhole loading pattern (pump position versus loading as shown on a dynamometer graph) so that walking beam movement yields the desired downhole pump movement. The net result is that the downhole pump 312 is driven in an optimum manner, referring to optimum recovery by altering stroke length, frequency, dwell time and waveform at the surface.

While the foregoing is directed to the preferred embodiment of the present invention, other and further embodiments of the invention may be devised without departing from the basic concept thereof, and the scope thereof is determined by the claims which follow.

I claim:

1. An apparatus for use in operating a walking beam oil well pumping mechanism which connects to the downhole pump by means of sucker rods and which sucker rods impart a weight to the walking beam, the weight to be offset by a counterbalance force, and wherein the walking beam rotates about a pivot, comprising:

(a) a generally upstanding, closed tank having a piston rod extending therefrom, the tank and piston rod being installed as a unit beneath the walking beam to force the walking beam upwardly and to impart a force thereto serving as a counterbalance force against the weight of sucker rods on the walking beam;

(b) an air inflatable portion in said tank which adjustably varies the pressure within the tank to vary the counterbalance force acting on the walking beam;

(c) a pneumatically urged first piston affixed to an end of said piston rod sealingly received in an upstanding, cylindrical sleeve concentrically located about said piston rod, said first piston having an upper face exposed to air pressure levels maintained in said closed tank; and (d) a hydraulically operated second piston affixed to said piston rod sealingly received in a cylinder housing mounted in said closed tank below said cylindrical sleeve, said piston rod extending through said cylinder housing, and said second piston moveable in two directions to reciprocate the piston rod and thereby impart a pumping stroke to the walking beam.

2. The apparatus of claim 1, wherein said cylinder housing is a closed-ended hydraulic cylinder having upper and lower chambers, each adapted to receive hydraulic fluid therein for operation of said second piston.

3. The apparatus of claim 2, wherein said piston rod passes through said upper and lower chambers and the upper and lower faces of said second piston are equal in area.

4. The apparatus of claim 2 including upper and lower hydraulic inlet means connected to said closed-ended hydraulic cylinder.

5. The apparatus of claim 1 including an oil lubricating system for providing lubricating oil to said first piston.

6. The apparatus of claim 5 wherein said oil lubricating system includes a lower sump adjacent to the lower end of said cylindrical sleeve adapted to receive and store a specified quantity of lubricating oil therein and further including an enlargement on said piston rod which moves into said sump to pressurize oil in said sump, said sump communicating through an outlet line and serial check valve in said outlet line for delivery of pumped oil from said sump to the top of said first piston.

7. The apparatus of claim 1 including:

(a) a hydraulic pump operatively connected for delivering hydraulic oil to said cylinder housing for bidirectional operation of said second piston;

(b) a variable speed motor;

(c) a cam rotated by said variable speed motor;

(d) a valve;

(e) a cam follower operatively connected to said valve to open and close said valve in response to motion coupled to said valve by said cam follower on contact with said cam; and (f) means for advancing and retarding said cam in response to actual movement of the walking beam.

8. An apparatus for use in operating a walking beam oil well pumping mechanism which connects to the downhole pump by means of sucker rods and which sucker rods impart a weight to the walking beam, the weight to be offset by a counterbalance force, and wherein the walking beam rotates about a pivot, comprising:

(a) a generally upstanding, closed tank having a piston rod extending therefrom, the tank and piston rod being installed as a unit beneath the walking beam to force the walking beam upwardly and to impart a force thereto serving as a counterbalance force against the weight of sucker rods on the walking beam;

(b) an air inflatable portion in said tank which adjustably varies the pressure within the tank to vary the counterbalance force acting on the walking beam;

(c) a pneumatically urged first piston affixed to an end of said piston rod sealingly received in an upstanding, cylindrical sleeve concentrically located about said piston rod, said first piston having an upper face exposed to air pressure levels maintained in said closed tank;

(d) a hydraulically operated second piston affixed to said piston rod sealingly received in a cylinder housing mounted in said closed tank below said cylindrical sleeve, said piston rod extending through said cylinder housing, and said second piston moveable in two directions to reciprocate the piston rod and thereby impart a pumping stroke to the walking beam;

(e) an oil lubricating system for providing lubricating oil to said first piston; and (f) a lower sump adjacent the lower end of said cylindrical sleeve adapted to receive and store a specified quantity of lubricating oil therein, said piston rod including an enlargement which moves into said sump to pressurize oil in said sump, said sump communicating through an outlet line and a serial check valve in said outlet line for delivery of pumped oil from said sump to the top of said first piston.

* * * * *